United States Patent [19]

Olson et al.

[11] Patent Number: 4,681,914

[45] Date of Patent: Jul. 21, 1987

[54] SOLID CAST DETERGENTS CONTAINING ENCAPSULATED HALOGEN BLEACHES AND METHODS OF PREPARATION AND USE

[75] Inventors: Keith E. Olson, Apple Valley; Kent R. Brittain, Eagan, both of Minn.

[73] Assignee: Ecolab Inc., St. Paul, Minn.

[21] Appl. No.: 861,064

[22] Filed: May 8, 1986

Related U.S. Application Data

[63] Continuation-in-part of Ser. No. 728,748, Apr. 30, 1985.

[51] Int. Cl.[4] ..... C11D 7/06; C11D 7/56; C11D 11/00; C11D 17/00

[52] U.S. Cl. ..... 252/91; 252/92; 252/99; 252/102; 252/103; 252/135; 252/156; 252/174; 252/174.13; 252/186.35; 252/186.36; 252/535; 252/554; 252/DIG. 16

[58] Field of Search ..... 252/91, 174.13, 186.35, 252/186.36, 92, 134, 174, 535, 554, DIG. 16; 427/212, 213, 215, 220

[56] References Cited

U.S. PATENT DOCUMENTS

| | | | |
|---|---|---|---|
| 3,154,494 | 10/1964 | Speak et al. | 252/96 |
| 3,293,188 | 12/1966 | Brown et al. | 252/187 |
| 3,361,675 | 1/1968 | Fuchs et al. | 252/99 |
| 3,637,509 | 1/1972 | Brennan | 252/99 |
| 3,649,545 | 3/1972 | Susuki | 252/174 |
| 3,650,961 | 3/1972 | Hudson | 252/99 |
| 3,663,449 | 5/1972 | Susuki | 252/174 |
| 3,687,717 | 8/1972 | Philip | 117/100 |
| 3,908,045 | 9/1975 | Alterman et al. | 427/213 |
| 3,983,254 | 9/1976 | Alterman | 428/403 |
| 4,124,521 | 11/1978 | Jedzinak | 252/127 |
| 4,126,573 | 11/1978 | Johnston | 252/99 |
| 4,279,764 | 7/1981 | Brubaker | 252/99 |
| 4,460,490 | 7/1984 | Barford | 252/92 |
| 4,569,780 | 2/1986 | Fernholz | 252/92 |
| 4,569,781 | 2/1986 | Fernholz | 252/90 |

*Primary Examiner*—Dennis L. Albrecht

*Attorney, Agent, or Firm*—Merchant, Gould, Smith, Edell, Welter & Schmidt

[57] ABSTRACT

An active-halogen bleach such as dichloroisocyanurate encapsulated in a coating of dihydratea synthetic detergent such as sodium octyl sulfonate. The capsule may further comprise an initial coating of a soluble inorganic detergent builder or filler such as an alkali metal phosphate or sulfate. The capsule is stable in highly alkaline environments such as detergent compositions.

Solid cast detergent-bleach composition having minimal bleach degradation comprising an alkaline hydratable chemical such as sodium hydroxide, a hardness sequestrant such as sodium tripolyphosphate, water of hydration and encapsulated active-halogen bleach formed in accordance with this invention. Optionally the detergent-bleach composition may contain a polyelectrolyte such as polyacrylate.

33 Claims, 1 Drawing Figure

SOLID CAST DETERGENTS CONTAINING ENCAPSULATED HALOGEN BLEACHES AND METHODS OF PREPARATION AND USE

This application is a continuation-in-part of Application Ser. No. 728,748, filed Apr. 30, 1985.

FIELD OF THE INVENTION

This invention relates to encapsulated active-halogen bleach compositions, methods of making the encapsulated active-halogen bleach compositions and detergent compositions containing encapsulated active-halogen bleach. The encapsulated active-halogen bleach composition provides improved stability of the bleach when employed in an alkaline environment such as in a detergent-bleach composition.

BACKGROUND OF THE INVENTION

The effectiveness of a detergent-bleach composition depends upon several factors including temperature of the washing solution, the nature of the soil being removed, the nature and concentration of the active cleaner, nature and concentration of the bleach, hardness of the water and the like. One important factor, in maintaining an effective concentration of bleach, is the stability of the bleach in the detergent-bleach composition. An active-halogen bleach can react with other components in a detergent-bleach composition resulting in a substantial loss of active-halogen bleach and a corresponding loss of other reactant.

Many encapsulating procedures known in the art suggest coating a particle of bleach to isolate it from other reactive components so that it may be usefully employed in a detergent composition. However, many of these encapsulated bleaches are not stable in highly alkaline environments. Further, the suggested encapsulating compounds such as tetrapotassium phosphate, hydratable inorganic salts and $C_{12-22}$ fatty acids must be dissolved in the wash water to release the core of active halogen. As a result, the encapsulating compounds generally remain in the wash water and can interfere in either the washing or bleaching process. Further, the suggested encapsulating compounds do not act as an active detersive ingredient but are merely present to encapsulate the active-halogen bleach, thereby increasing the cost and decreasing the percentage of active components. An encapsulating compound which also acts as an active cleansing component would eliminate the introduction of unnecessary and unwanted compounds into the washing solution, reduce the cost of the detergent-bleach composition and increase the percentage of active components in the detergent bleach composition.

Encapsulation of an active-halogen source with a single inorganic coating is known in the art. Several examples of such compositions is disclosed in Brubaker, U.S. Pat. No. 4,279,764, Brennan, U.S. Pat. No. 3,637,509, Idudson, U.S. Pat. No. 3,650,961, and Alterman, U.S. Pat. Nos. 3,983,254 and 3,908,045. Brubaker discloses a bleaching composition comprising a chlorine bleach coated with a silicate bound, hydrated, soluble salt having an N—H chlorine accepting component. Brubaker discloses that the composition is useful in preventing dye and fabric damage caused by bleach particles during machine washing of fabrics. Brennan discloses the encapsulation of a mixture of an organic chlorinating agent and an alkali metal tripolyphosphate with tetrapotassium phosphate. Brennan discloses that the composition provides improved chlorine stability. Hudson discloses fluidized bed encapsulation with a hydratable inorganic salt. Hudson discloses that the core is a bleach the capsule provides improved bleach stability in detergent compositions. The Alterman patents disclose encapsulation with a $C_{12-22}$ fatty acid and, when the core is a chlorine releasing agent, further encapsulation with a second coat of an alkali hydroxide. Alterman discloses that the capsule is effective in preventing bleach from causing pinholes in washed fabrics.

Accordingly, a substantial need exists for an oxidizing halogen bleach that is stable in a highly alkaline environment, does not substantially degrade other cleaning components, and does not introduce unwanted and unnecessary components into the wash water. Further, a substantial need exists for a highly alkaline storage stable detergent-bleach composition having substantially no degradation of the bleach contained therein.

SUMMARY OF THE INVENTION

We have discovered that the problem of stabilizing and active-halogen bleach in an alkaline environment, such as a detergent-bleach composition, may be solved by encapsulating the bleach in a synthetic detergent or in a first coating of a soluble inorganic coating agent followed by a coating of a synthetic detergent. We have discovered that the double coating is not always required as a single coating of a synthetic detergent can, in certain instances, fully isolate the bleach. However, we have discovered that isolation of the bleach can be assured by coating the bleach with a first coat of an inorganic coating agent and a second coat of a synthetic detergent. We believe that the first coat of inorganic coating agent prevents minimal degredation of the bleach by the synthetic detergent by physically separating the bleach and the synthetic detergent and also promotes adherence of the synthetic detergent. Preferably the inorganic coating agent is a detergent builder and the detergent builder and synthetic detergent are components useful in the cleaning composition in which they are added.

A first aspect of the invention is an active-halogen bleach encapsulated with sufficient synthetic detergent to prevent any substantial reaction between the active-halogen bleach and other cleaning components.

A second aspect of the invention is an active-halogen bleach encapsulated with a first layer of an inorganic coating agent and a second layer of a synthetic detergent.

A third aspect of the invention provides a method for making the encapsulated active-halogen bleach.

A fourth aspect of the invention is a solid, cast detergent-bleach composition wherein the encapsulated active-halogen bleach of the present invention is incorporated in a solid, cast highly alkaline detergent composition.

A fifth aspect of the invention provides a method for making the solid, cast detergent-bleach composition.

For purposes of this application, "halogen bleach", or "active-halogen" encompasses active-halogen containing oxidization and bleaching compositions which are capable of releasing one or more oxidizing halogen species (typically —OCL—).

For purposes of this application "inorganic coating agent" encompasses all soluble inorganic compounds which may be used as a detergent filler or builder and which do not substantially react with halogen-bleaches.

DETAILED DESCRIPTION OF THE INVENTION

Figure 1:
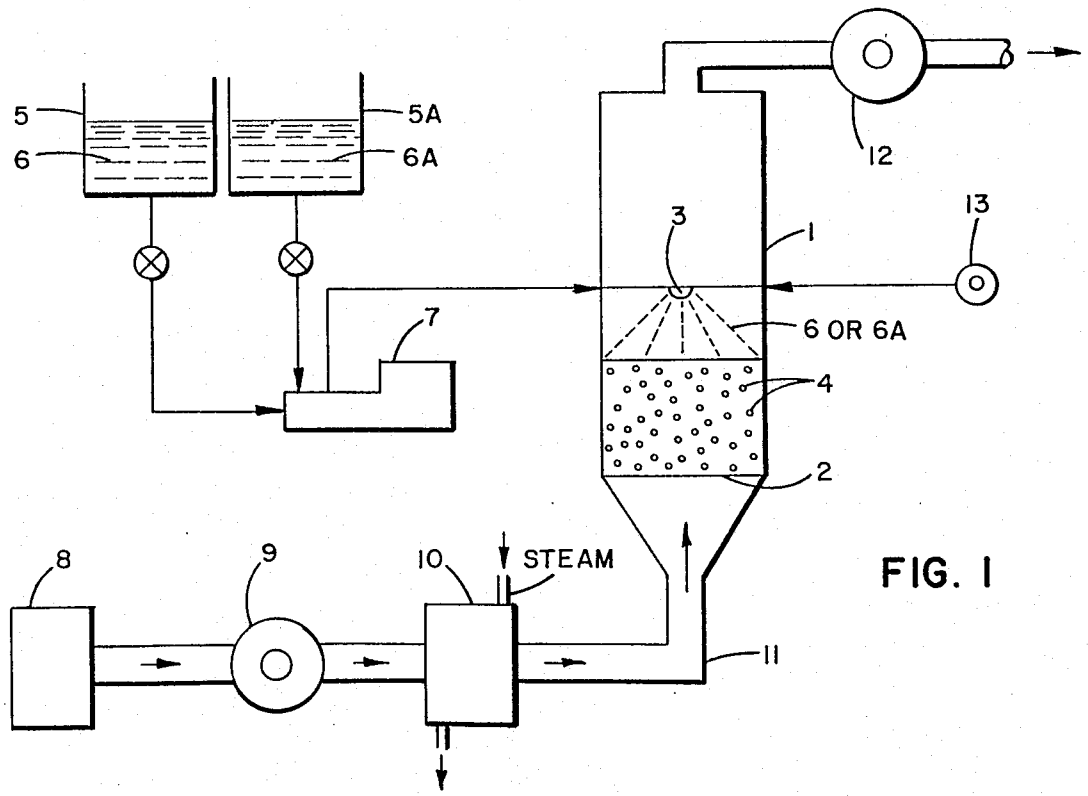

In a first embodiment the encapsulated halogen bleaches of this invention comprise an active halogen bleach core and at least one synthetic detergent coating. In a second, preferred embodiment the encapsulated halogen bleaches comprise an active-halogen bleach core, a first coating of an inorganic coating agent and a second coating of a synthetic detergent.

HALOGEN BLEACH

Halogen releasing substances suitable as a core material in the present invention include halogen components capable of liberating active halogen species such as a free elemental halogen (X) or an oxidized halogen (—OX—), under conditions normally encountered during detergent-bleach cleaning processes. Preferably the halogen releasing compound releases chlorine or bromine species. Most preferably the halogen releasing compound releases chlorine species. A nonexhaustive list of chlorine releasing compounds which may be employed as the core material in the present invention include potassium dichloroisocyanurate, sodium dichloroisocyanurate, chlorinated trisodium phosphate, calcium hypochloride, lithium hypochloride, monochloramine, dichloramine, [(monotrichloro)-tetra(monopotassium dichloro)]pentaisocyanurate, 1,3-dichloro-5,5-dimethyl hydantoin, paratoluene sulfondichloro-amide, trichloromelamine, N-chlorammeline, N-chlorosuccinimide, N,N'-dichloroazodicarbonamide, N-chloro-acetyl-urea, N,N'-dichlorobiuret, chlorinated dicyandiamide, trichlorocyanuric acid, 1-chloro-3-bromo-5-5-dimethyl hydantoin, 1-3-dichloro-5-ethyl-5-methyl hydantoin, 1-choro-3-bromo-5-ethyl-5-methyl hydantoin, and dichlorohydantoin.

For reasons of excellent bleaching properties and ease of availability the preferred halogen releasing compound is dichloroisocyanurate dihydrate, represented by the chemical formula:

$$NaCl_2C_3N_3O_3.2H_2O$$

Dichloroisocyanurate dihydrate is commercially available from Monsanto in granular form.

SYNTHETIC DETERGENT

The synthetic detergent must remain sufficiently solid at temperatures likely to be encountered during storage of the encapsulate (about 15° to 50° C.) and must also remain sufficiently stable at temperatures likely to be encountered during processing (about 15° to 95° C.)

Synthetic detergents that may be employed in the present invention include the anionic, cationic, nonionic and amphoteric types. The preferred synthetic detergents are anionic. A nonlimiting list of anionic detergents useful in the present invention include the alkyl monomolecular aromatic alkali-metal sulfonates such as the $C_{4-14}$ alkylbenzenesulfonates disclosed in U.S. Pat. No. 2,477,382 (alkyl derived from polypropylene), U.S. Pat. No. 3,370,100 (alkyl a hexene dimer or trimer), and U.S. Pat. No. 3,214,462 (alkyl derived from alphaolefins). Also useful are the primary and secondary alkyl and alkylene sulfates and fatty alcohol sulfates.

A particularly suitable synthetic detergent for use in the present invention is preoxidized sodium octyl sulfonate. The sodium octyl sulfonate may contain a minor amount of 1,2 alkane bisulfonate as a by-product of manufacture which does not appear to affect the usefulness of sodium octyl sulfonate as a coating in the present invention.

The synthetic detergent may be applied as a melt or preferably in solution. When applied in solution water is the preferred solvent because of its compatibility and substantially non-reactivity with chlorine releasing agents, non-flammablity, and nontoxicity.

A capsule formed in accordance with the present invention may be formulated with a detergent to provide a commercially valuable detergent-bleach composition.

SOLUBLE INORGANIC COATING AGENT

The inorganic coating agent must be water soluble, remain sufficiently solid at temperatures likely to be encountered during storage of the capsule (about 15° to 50° C.), and remain sufficiently stable at temperatures likely to be encountered during processing (about 15° to 95° C.).

Preferably the inorganic coating agent is a detergent builder or filler which itself is a useful detergent component in the cleaning composition in which the bleach is incorporated.

A nonlimiting list of inorganic detergent fillers suitable for use as a coating agent in the present invention includes: alkalies such as sodium carbonate, sodium bicarbonate, sodium sesquicarbonate, sodium borate, sodium tetraborate, potassium carbonate, potassium bicarbonate, potassium sequicarbonate, potassium borate and potassium tetraborate; phosphates such as forms of mono, di and trisodium phosphate, mono, di and tripotassium phosphate, anhydrous hydrated diammonium phosphate, monocalcium phosphate monohydrate, tricalcium phosphate, calcium pyrophosphate, iron pyrophosphate, magnesium phosphate, monopotassium orthophosphate, potassium pyrophosphate, dry, disodium orthophosphate, dihdydrate, trisodium orthophosphate, decahydrate, tetrasodium pyrophosphate, sodium tripolyphosphate and sodium phosphate glass; neutral soluble salts such as sodium sulfate and sodium chloride; silicates such as water soluble silicates having an $SiO_2$:$Na_2O$ ratio of between about 1.6–3.2.

A nonlimiting list of suitable detergent builder compounds includes tetrasodium and tetrapotassium pyrophosphate, pentasodium and pentapotassium tripolyphosphate, anhydrous and hydrated forms of sodium and potassium silicates, sodium trimetaphosphates, sodium borates, sodium and potassium carbonates, bicarbonates, sesquicarbonates, phosphates and polyphosphonates.

ENCAPSULATION PROCESS

The protective, passivating, encapsulating coatings of the present invention may be conveniently applied by means of a fluidized bed apparatus, shown schematically in FIG. 1.

Referring to FIG. 1, the coating or encapsulation of the bleach particles 4 is accomplished in coating chamber or cylindrical tower 1. A distributor plate 2 is located at the base of tower 1. An unexpanded bed of the particles 4 to be coated is placed within tower 1 in resting engagement with distributor plate 2. A downwardly projecting spray nozzle 3 is adjustably disposed within tower 1, and adapted to be vertically adjusted so that the coating material 6, discharged in a downwardly diverging three-dimensional spray pattern from nozzle 3, just covers the entire upper surface area of an expanded bed of the particles 4.

Coating material 6 contained in vessel 5 is fed to nozzle 3 by pump 7. The spray of coating material 6 from nozzle 3 may be aided by pressurized air entering tower 1 at inlet 13. A fluidizing gas flow created by a blower 9 passes through duct 11 and distributor plate 2. The gas flow may be either cooled by cooling system 8 or heated by heat exchanger 10 as necessary, to maintain the fluidizing gas within the desired temperature range. An exhaust blower 12 may be employed to remove solvent vapors.

A multiplicity of core particles 4 is placed on distributor plate 2. Air is caused to flow through duct 11 and distributor plate 2 by blower 9, fluidizing the particles 4 (i.e. maintaining the particles in a state of continuous motion within a volume which is greater than the volume defined by the particles at rest). The liquid synthetic detergent 6 contained in vessel 5 is sprayed by pump 7 through nozzle 3 onto the fluidized particles 4 until all particles 4 in the bed are completely coated. Particles 4 coated by the above-described procedure are completely encapsulated with a continuous coating of coating substance 6, and are free-flowing and nonagglomerated.

It is important that the entire surface area of each particle be covered to prevent the core of halogen bleach from reacting with an alkaline environment.

When it is desired to apply a first inorganic coating agent with a subsequent coating of a synthetic detergent, the two coats may be applied in any conveniently and economical manner. For instance, the two coatings may be applied by spraying on the inorganic coating agent, emptying solution tank 5 of inorganic coating agent, filling solution tank 5 with synthetic detergent and spraying on the synthetic detergent. Alternatively, the two coatings may be applied utilizing a second solution tank 5A connected to pump 7 and filled with synthetic detergent. The fluidized particles would be coated with the inorganic coating agent contained in solution tank 5, the inorganic coating agent allowed to dry and the dry particles then coated with the synthetic detergent contained in solution tank 5A. A third method of applying the two coatings is to coat the core particles 4 with the first inorganic coating agent in a first fluidized bed apparatus, allowing the once coated particles to dry, placing the once coated particles in a second fluidized bed apparatus and coating the particles with the synthetic detergent.

Before removal of the encapsulated oxidizing halogen bleach from the fluidized bed the bed temperature may be increased to drive off solvent remaining in the capsule. However, the temperature should be kept below the melting temperature of the coatings and below the degradation temperature of the encapsulated halogen-bleach.

When a single coating is employed the encapsulated halogen bleach particles of the present invention can comprise about 20 to 90 wt-% halogen bleach core and about 10 to 80 wt-% synthetic detergent coating. When a double coating is employed the particles can comprise about 20 to 90 wt-% halogen bleach core, about 0.5 to 50 wt-% inorganic coating agent first coat, and about 5 to 70 wt-% synthetic detergent second coat.

More particularly, the single coated halogen bleach can comprise about 30 to 80 wt-% halogen bleach core and about 20 to 70 wt-% synthetic detergent coating. Most particularly, the single coated halogen bleach can comprise about 40 to 55 wt-% halogen bleach source core and about 45 to 60 wt-% synthetic detergent coating.

More particularly the double coated halogen bleach can comprise about 30 to 80 wt-% halogen bleach core, about 5 to 50 wt-% first inorganic coating agent coating, and about 5 to 50 wt-% second synthetic detergent coating. Most particularly, the double coated halogen bleach can comprise about 30 to 60 wt-% halogen bleach core, about 15 to 45 wt-% first inorganic coating agent coating, and about 10 to 35 wt-% second synthetic detergent coating.

DETERGENT COMPOSITION

Detergent compositions within which the encapsulated bleach of the present invention can find utility may broadly be represented by the following list of components and proportions thereof:

| | Approximate Percentage |
|---|---|
| Anionic or nonionic detergent | 1–90 |
| Organic and/or inorganic builders (including alkaline builders) | 0–95 |
| Encapsulated bleaching agent | 0.5–25 |
| Optical brightener | 0–0.3 |
| Water | 5–50 |
| Filler | 0–25 |

While the encapsulated bleach of the present invention may be incorporated into nearly any detergent composition it finds particular utility in combination with solid cast highly alkaline detergent compositions as hereinafter described.

We have discovered a storage-stable solid cast detergent-bleach composition having substantially no deactivated halogen bleach which comprises an alkaline hydratable chemical a halogen bleach encapsulated in accordance with the present invention and water. The detergent composition may further contain a sequestrant or chelating agent. When employed, the sequestrant or chelating agent is also preferably a hydratable chemical.

A nonlimiting list of alkaline hydratable chemicals which may be employed in the present invention includes alkali metal hydroxides such as sodium and potassium hydroxide; silicates such as sodium metasilicate; phosphates, particularly phosphates of the formula $M—(PO_3M)_nOM$ or the corresponding cyclic compounds $PO_3M-(PO_3M)_nPO_3M$ wherein M is an alkali metal and n is an integer from 1 to 60; polyphosphates such as sodium and potassium pyrophosphate, sodium tripolyphosphate and sodium hexametaphosphate; carbonates such as sodium and potassium carbonate; and borates such as sodium borate. Combinations of two or more hydratable chemicals such as sodium hydroxide and sodium tripolyphosphate have been found to work particularly well.

The water, used to form a uniform medium, may be added as a separate ingredient or in combination with one of the other components, for example as an aqueous solution of 50% sodium hydroxide.

A nonlimiting list of sequestrants and chelating agents which may be usefully employed in the present invention includes alkali metal condensed phosphates such as sodium or potassium pyrophosphate, sodium tripolyphosphate, amino trimethylene phosphonate and sodium hexametaphosphate; polycarboxylate compounds such as polymaleic acid, polyfumaric acid and copolymers of acrylic and itaconic acid, polyelectrolytes such as the polyacrylates, etc. For reasons of high alkalinity and ease of availability, the preferred alkaline hydratable chemical is sodium hydroxide or a mixture of sodium hydroxide and a sodium condensed phosphate. The preferred sequestrant is a polyacrylate.

A typical four-component detergent-bleach composition can contain (1) an alkali metal hydroxide, (2) a halogen bleach encapsulated in accordance with the present invention, (3) a hydratable hardness-precipitating or hardness sequestering agent, and (4) water.

The solid cast detergent-bleach composition will normally be comprised of at least about 30 wt-%, preferably at least about 60 wt-% hydratable chemical(s) from components 1 and 3, at least 5 wt-%, preferably about 10–35 wt-% water, and about 0.5 to 25 wt-%, preferably about 3 to 12 wt-%, encapsulated halogen bleach.

For clarity, the process of making the detergent-bleach composition of the present invention will be described with reference to the preferred components and preferred variable ranges. This is not intended to limit the process to those components and ranges only. Other components and similar processes may be employed to form a solid cast detergent-bleach composition in accordance with the present invention.

A particularly useful detergent-bleach composition may be formed by (i) adding sufficient anhydrous sodium hydroxide to water to form a 40 to 80 wt-% caustic solution, (ii) heating about 20–75 wt-% of the caustic solution to a temperature between about 55° to 95° C., (iii) blending about 10 to 45 wt-% anhydrous sodium tripolyphosphate and any other additive such as a filler, a dye etc. to the highly caustic solution to form the detergent composition, (iv) dispensing about 0.5 to 25 wt-% of encapsulated halogen-bleach into the detergent composition to form the detergent-bleach composition, and (v) cooling the detergent-bleach composition to form a solid cast detergent composition. Preferably, the detergent-bleach composition is cast into a receptable before complete solidification.

If desired, about 0 to 15 wt-% polyacrylate may be blended with the highly caustic solution in order to add a sequestrant to the composition.

We have found that it is not necessary to dissolve the sodium tripolyphosphate, encapsulated bleach or polyacrylate to achieve a substantially homogeneous composition as they may be stably suspended in the solidified detergent-bleach composition in order to achieve a substantially homogeneous dispersion. The composition is preferably continuously mixed during the process. However, in order to further substantially reduce the amount of reaction between the halogen bleach and the other detergent-bleach components the encapsulated bleach is dispersed into the detergent composition with a minimum of agitation. One method of substantially uniformly dispersing the encapsulated halogen-bleach into the detergent composition with a minimum amount of agitation is to simultaneously add the encapsulated halogen bleach and the detergent composition into a single container. The rate of feed should be metered so that sufficient detergent composition is remaining to "top-off" the resultant detergent-bleach composition and prevent unbound capsules from resting on top.

The detergent composition may be cast into a temporary mold from which it is subsequently transferred into a separate receptacle for shipping and sale, or may be cast directly into the receptacle used for shipping and sale. Preferably, the composition is cast directly into the final container in order to eliminate the transfer step.

Solidification of the detergent-bleach composition may be done in any convenient manner such as cooling under room conditions, quenching in a cooling tank or cooling in a refrigerated unit. To reduce the chances of the detergent composition eating through the halogen bleach coatings and reacting with the halogen bleach, the detergent-bleach composition is preferably colled rapidly as by a water spray.

Either during or after solidification a cover or cap can be placed over the opening in the receptacle to seal the solid cast detergent-bleach composition until used.

The receptacle may be made of any material capable of housing the detergent composition, including but not limited to glass; metals such as aluminum and steel; and structural resins such as polyolefins (polyethylene), polyesters (mylar), polyamide (nylon), etc. When the detergent composition is cast directly in the receptacle, the receptacle must be capable of withstanding temperatures encountered during the casting process. For reasons of cost, the preferred material is a polyolefin with polypropylene being the most preferred.

As shown in FIG. 2, a preferred means of dispensing the detergent-bleach composition is from a spray-type dispense. In a spray-type dispenser a water spray 31 is impinged upon an exposed surface(s) 21 of the solid block detergent-bleach composition 20, thereby dissolving a portion of the composition 20 and forming a concentrated detergent-bleach solution which is allowed to pass out of the dispenser 10.

The most preferred means of dispensing the detergent composition is disclosed in co-pending U.S. patent application Ser. No. 817,399 wherein (i) the composition is cast directly into a right angle cylindrical container from which the composition is dispensed, (ii) an exposed surface of the composition is placed upon and supportably engaged by a right angle cylindrical screen, and (iii) water is sprayed onto the exposed surface of the composition, dissolving the composition and forming a concentrated solution. Such a dispenser allows the composition to be dispensed without removing it from the container and dispenses a concentrated solution of substantially constant concentration over the lifetime of the detergent-bleach block as it maintains a relatively constant distance between the dissolving exposed surface of the composition and the spray nozzle.

For dispensing from the preferred dispenser, the container must leave at least one surface of the detergent composition exposed, preferably leaving only a single exposed surface, so that water may be impinged upon the detergent-bleach composition.

The detergent-bleach composition may be cast into any suitable size and shape but, for reasons of (i) shortening the time period necessary to complete solidification of the composition, (ii) presenting an exposed surface sufficiently large to allow dispensing at an effective rate, and (iii) ease of shipping and handling, the preferred size of the detergent composition receptacle is between about 3 to 10 liters with an exposed surface area of about 50 to 500 square centimeters, and most preferably between abut 3 to 4 liters with an exposed surface area of about 150 to 200 square centimeters.

Other commonly employed detergent components may be present in the detergent-bleach compositions of the invention. Typical examples include the well-known soil suspending agents, corrosion inhibitors, dyes, perfumes, fillers, optical brighteners, enzymes, germicides, anti-tarnishing agents, and the like.

The invention may be more fully understood by reference to the following Examples.

EXAMPLE 1

5.71 lbs. of granular dichloroisocyanurate dihydrate having particle sizes between 10 to 60 U.S. mesh were placed onto the distributor plate of a fluidized bed apparatus. The particles were fluidized and the temperature of the bed maintained between 43° and 83° C.

A synthetic detergent coating solution was prepared by dissolving 5.55 lbs. of a 40% aqueous solution of sodium octyl sulfonate in 5.55 lbs. of soft water.

The synthetic detergent coating solution was sprayed onto the fluidized bleach particles through a spray nozzle for one hour. The coated particles were of substantially uniform size, dry and free flowing. The coated particles comprised between 60 to 85 wt-% dichloroisocyanurate dihydrate bleach core.

EXAMPLE 2

5.71 lbs. of granular dichloroisocyanurate dihydrate having particle sizes between 10 to 60 U.S. mesh were placed onto the distributor plate of a fluidized bed apparatus. The particles were fluidized and the temperature of the bed maintained between 43° and 83° C.

A first coating solution was prepared by dissolving 2.71 lbs. of sodium sulfate and 0.90 lbs. of sodium tripolyphosphate in 11.3 lbs. of soft water. The first coating solution was sprayed onto the fluidized bleach particles through a spray nozzle for one hour. The once coated particles were of substantially uniform size, dry and free flowing.

A second coating solution was prepared by dissolving 5.55 lbs. of a 40% aqueous solution of sodium octyl sulfonate in 5.55 lbs. of soft water. The second coating solution was sprayed onto the fluidized once coated particles in the same manner as the first coating was sprayed onto the particles.

After addition of the second coating the bed temperature was allowed to rise to about 83° C. to evaporate free moisture from the coated particles.

The twice coated particles were of substantially uniform size, dry and free flowing.

EXAMPLE 3

Into a 5 gallon vessel provided with a stirring means and a heating means was placed 6,547 grams (20.6 wt-%) of a 50 wt-% sodium hydroxide solution. The sodium hydroxide solution was heated to 55°–60° C. 858 grams (2.7 wt-%) water was blended into the sodium hydroxide solution. 9,629 grams (30.3 wt-%) anhydrous sodium hydroxide was blended into the solution to form a highly caustic solution. 10,138 grams (31.9 wt-%) anhydrous sodium tripolyphosphate was blended into the highly caustic solution to form a liquid detergent composition. The solution was stirred until the anhydrous sodium hydroxide and anhydrous sodium tripolyphosphate were thoroughly dispersed. 0.95 grams (0.003 wt-%) dye and 159 grams (0.5 wt-%) nonionic surfactant were added to the liquid detergent solution and mixed until a homogeneous color was obtained. Mixing was continued for 10 minutes without heat to thicken the liquid detergent composition. Nearly 1 gallon of the thickened detergent composition at 65° C. was poured into a 1 gallon container. 409 grams of encapsulated chlorine bleach made in accordance with Example 2 was placed into a vibratory feeder positioned to fill a 3 liter polyolefin container. The encapsulated chlorine bleach and the thickened detergent composition were fed simultaneously into the 3 liter bottle with the encapsulated chlorine fed from the vibratory feeder and the thickened detergent composition poured manually from the 1 gallon container. The rate of feed of both components was regulated so that approximately ½ to 1 lb. of detergent composition was available to "top off" the 3 liter bottle to prevent loose, non-wetted encapsulated chlorine particles from remaining on the top of the detergent-bleach composition. The container was capped and allowed to cool for 24 hours at room temperature, forming a solid cast chlorinated highly alkaline detergent composition. The final weight of the detergent bleach composition was 9 lbs.

EXAMPLE 4

Several chlorinated highly alkaline detergent compositions formed in accordance with Example 3 were removed from their containers and each placed in 240 lbs. of water in a low shear GROEN mixer. The solution was mixed for 2 hours until the chlorinated highly alkaline detergent composition was completely dissolved. A sample was taken and available chlorine titration conducted on the sample. Calculation of the percent available chlorine still remaining for each composition is tabulated in Table 1 following.

| Sample No. | Sample Storage Temperature | Initial Average Chlorine | Percent Chlorine Retained at Indicated Storage Time | | | | | | |
|---|---|---|---|---|---|---|---|---|---|
| | | | 1 Week | 2 Weeks | 3 Weeks | 4 Weeks | 5 Weeks | 6 Weeks | 7 Weeks |
| 1 | 70 | 29.56 | | 103.4 | 97.0 | 103.5 | 101.00 | | |
| 2 | 70 | 30.71 | | 102.28 | | 101.3 | | 100.3 | |
| 3 | 70 | 28.11 | | 101.78 | | 99.95 | | 100.0 | |
| 4 | 70 | 31.19 | | 97.91 | | 99.56 | | 100.0 | |

The specification and Examples are presented above to aid in the complete non-limiting understanding of the invention. Since many variations and embodiments of the invention can be made without departing from the spirit and scope of the invention, the invention resides in the claims hereinafter appended.

We claim:

1. A solid, cast detergent-bleach composition, comprising:

(a) at least 30 wt-%, based upon the composition, alkaline hydratable chemical;

(b) an effective amount of a hardness-sequestrant wherein the hardness-sequestrant is different than the alkaline hydratable chemical;

(c) about 0 to 15 wt-%, based upon the composition, polyelectrolyte wherein the polyelectrolyte is different than the alkaline hydratable chemical and the hardness-sequestrant;

(d) at least 5 wt-%, based upon the alkaline hydratable chemical, water of hydration; and (e) about 0.5 to 25 wt-%, based upon the composition, randomly dispersed encapsulated bleach particles, comprising:

(i) about 20 to 90 wt-%, based upon the encapsulated bleach particles, core which comprises a source of active-halogen bleach;

(ii) about 0 to 50 wt-%, based upon the encapsulated bleach particles, first coating which comprises a soluble inorganic coating agent; and (iii) about 10 to 80 wt-%, based upon the encapsulated bleach particles, second coating which comprises a synthetic detergent.

2. The composition of claim 1 wherein the alkaline hydratable chemical is an alkali metal hydroxide.

3. The composition of claim 1 wherein the hardness-sequestrant is an alkali metal polyphosphate.

4. The composition of claim 2 wherein the hardness-sequestrant is an alkali metal polyphosphate.

5. The composition of claim 2 wherein the composition comprises at least 5 wt-%, based upon the composition, water.

6. The composition of claim 1 wherein the core comprises a source of active-chlorine.

7. The composition of claim 2 wherein the core comprises a source of active-chlorine.

8. The composition of claim 7 wherein the core comprises dichloroisocyanurate.

9. The composition of claim 1 wherein the first coating comprises a detergent builder salt.

10. The composition of claim 9 wherein the first coating comprises an alkali metal phosphate, alkali metal sulfate or mixtures thereof.

11. The composition of claim 2 wherein the first coating comprises an alkali metal phosphate, alkali metal sulfate or mixtures thereof.

12. The composition of claim 1 wherein the second coating comprises an alkyl sulfonate or an alkali metal salt thereof.

13. The composition of claim 2 wherein the second coating comprises an alkyl sulfonate or an alkali metal salt thereof.

14. The composition of claim 12 wherein the second coating comprises an alkali metal octyl sulfonate.

15. The composition of claim 1 wherein the encapsulated bleach particles comprise about 35 to 60 wt-% core, about 0 to 40 wt-% first coating and about 10 to 40 wt-% second coating, based upon the encapsulated bleach particles.

16. A solid, cast detergent-bleach composition, comprising:

(a) at least 30 wt-%, based upon the composition, sodium hydroxide;

(b) about 10 to 45 wt-%, based upon the composition, alkali metal polyphosphate;

(c) about 0 to 15 wt-%, based upon the composition, polyelectrolyte wherein the polyelectrolyte is different than (a) and (b);

(d) at least 5 wt-%, based upon the composition, water; and (e) about 0.5 to 25 wt-%, based upon the composition, of about 4 to 60 U.S. mesh substantially randomly dispersed encapsulated bleach particles, comprising:

(i) about 35 to 60 wt-%, based upon the encapsulated bleach particles, core which comprises a source of active-halogen bleach;

(ii) about 0 to 40 wt-%, based upon the encapsulated bleach particles, first coating which comprises an alkali metal phosphate, alkali metal sulfate, or mixtures thereof; and (iii) about 10 to 40 wt-%, based upon the encapsulated bleach particles, second coating which comprises an alkyl sulfonate or an alkali metal salt thereof.

17. A process for forming a substantially uniform solid cast detergent-bleach composition, comprising the steps of:

(a) heating about 20 to 75 wt-%, based upon the composition, of a 40 to 80 wt-% aqueous solution of an alkali metal hydroxide to about 50° to 95° C.;

(b) substantially uniformly distributing into the aqueous caustic solution:

(i) an effective amount of a wash water hardness sequestrant;

(ii) about 0 to 15 wt-%, based upon the composition, polyelectrolyte which is different than the hardness-sequestrant;

(iii) about 10 to 60 wt-%, based upon the composition, alkaline hydratable chemical which is different than the hardness-sequestrant and the polyelectrolyte; and (iv) about 0.5 to 25 wt-%, based upon the composition, encapsulated bleach particles comprising:

(A) about 20 to 90 wt-%, based upon the encapsulated bleach particles, core which comprises a source of active-halogen bleach;

(B) about 0 to 50 wt-%, based upon the encapsulated bleach particles, first coating which comprises a soluble inorganic coating agent; and (C) about 10 to 80 wt-%, based upon the encapsulated bleach particles, second coating which comprises a synthetic detergent; to form a liquid detergent-bleach composition; and (c) allowing the liquid detergent-bleach composition to thicken and solidify.

18. A process for forming a substantially uniform solid cast detergent-bleach composition, comprising the steps of:

(a) heating about 20 to 75 wt-%, based upon the composition, of a 40 to 80 wt-% aqueous solution of an alkali metal hydroxide to about 50° to 95° C.;

(b) substantially uniformly distributing into the aqueous solution:

(i) an effective amount of a wash water hardness sequestrant;

(ii) about 0–15 wt-%, based upon the composition, polyelectrolyte which is different than the hardness-sequestrant; and (iii) about 10 to 60 wt-%, based upon the composition, alkaline hydratable chemical which is different than the hardness-sequestrant and the polyelectrolyte; to form a liquid detergent composition;

(c) blending without substantial agitation about 0.5 to 25 wt-%, based upon the composition, encapsulated bleach particles and the liquid detergent composition, the encapsulated bleach particles comprising:

(i) about 20 to 90 wt-%, based upon the encapsulated bleach particles, core which comprises a source of active halogen bleach;

(ii) about 0 to 50 wt-%, based upon the encapsulated bleach particles, first coating which comprises a soluble inorganic coating agent; and (iii) about 10 to 80 wt-%, based upon the encapsulated bleach particles, second coating which comprises a synthetic detergent;

to form a liquid detergent-bleach composition; and (d) allowing the liquid detergent-bleach composition to thicken and solidify.

19. The process of claim 17 wherein the hardness sequestrant is an alkali metal polyphosphate.

20. The process of claim 18 wherein the hardness sequestrant is sodium tripolyphosphate.

21. The process of claim 17 wherein the polyelectrolyte is a polyacrylate.

22. The process of claim 17 wherein the alkaline hyratable chemical is anhydrous sodium hydroxide, an alkali metal condensed phosphate, or a combination of sodium hydroxide and an alkali metal condensed phosphate.

23. The process of claim 18 wherein the alkaline hydratable chemical is a combination of anhydrous sodium hydroxide and anhydrous sodium tripolyphosphate.

24. The process of claim 17 wherein the core comprises a source of active-chlorine.

25. The process of claim 18 wherein the core comprises dichloroisocyanurate.

26. The process of claim 17 wherein the first coating comprises a detergent builder salt.

27. The process of claim 26 wherein the first coating comprises an alkali metal phosphate, alkali metal sulfate or mixtures thereof.

28. The process of claim 18 wherein the first coating comprises an alkali metal phosphate, alkali metal sulfate or mixtures thereof.

29. The process of claim 17 wherein the second coating comprises an alkyl sulfonate or an alkali metal salt thereof.

30. The composition of claim 18 wherein the second coating comprises an alkyl sulfonate or an alkali metal salt thereof.

31. The process of claim 29 wherein the second coating comprises an alkali metal octyl sulfonate.

32. The process of claim 17 wherein the encapsulated bleach particles comprise about 35 to 60 wt-% core, about 0 to 40 wt-% first coating, and about 10 to 40 wt-% second coating, based upon the encapsulated bleach particles.

33. A process for forming a substantially uniform solid cast detergent-bleach composition, comprising the steps of:

(a) heating about 35 to 75 wt-%, based upon the composition, of a 40 to 80 wt-% sodium hydroxide aqueous solution, to about 50° to 95° C.

(b) substantially uniformally distributing in the aqueous solution;

(i) an effective amount of sodium tripolyphosphate as a wash water hardness sequestrant;

(ii) about 0 to 15 wt-%, based upon the composition, polyacrylate;

(iii) about 25 to 60 wt-%, based upon the composition, alkaline hydratable chemical selected from the group consisting of anhydrous sodium hydroxide, anhydrous alkali metal polyphosphate and mixtures thereof;

to form a liquid detergent composition;

(c) blending with the liquid detergent composition, without substantial agitation, about 3 to 12 wt-%, based upon the composition, encapsulated bleach particles, comprising:

(i) about 35 to 60 wt-%, based upon the encapsulated bleach particles, core which comprises dichloroisocyanurate;

(ii) about 0 to 40 wt-%, based upon the encapsulated bleach particles, first coating selected from the group consisting of alkali metal phosphates, alkali metal sulfates and mixtures thereof; and (iii) about 10 to 40 wt-%, based upon the encapsulated bleach particles, second coating comprising an alkyl sulfonate or an alkali metal salt thereof;

to form a liquid detergent composition; and (d) rapidly cooling the liquid detergent-bleach composition by contacting the composition with water in order to thicken and solidify the composition.

* * * * *